US007731425B2

(12) United States Patent
Lin et al.

(10) Patent No.: US 7,731,425 B2
(45) Date of Patent: Jun. 8, 2010

(54) POLYWOVEN PINCH BOTTOM OPEN MOUTH BAG

(75) Inventors: Paul Lin, Portland, OR (US); Yuming Pang, Portland, OR (US)

(73) Assignee: Standard Multiwall Bag Manufacturing Co., Beaverton, OR (US)

( * ) Notice: Subject to any disclaimer, the term of this patent is extended or adjusted under 35 U.S.C. 154(b) by 1028 days.

(21) Appl. No.: 11/454,168

(22) Filed: Jun. 15, 2006

(65) Prior Publication Data

US 2007/0292053 A1 Dec. 20, 2007

(51) Int. Cl.

| | |
|---|---|
| ***B65D 33/16*** | (2006.01) |
| ***B65D 33/30*** | (2006.01) |
| ***B65D 30/04*** | (2006.01) |
| ***B65D 30/20*** | (2006.01) |
| ***B65D 30/10*** | (2006.01) |
| ***B65D 30/12*** | (2006.01) |

(52) U.S. Cl. ..... 383/78; 383/89; 383/90; 383/117; 383/120; 383/123; 383/126

(58) Field of Classification Search ..... 383/123, 383/78, 3, 89, 90, 121, 120, 117, 126; 53/416, 53/469, 480, 481, 482, 284.7, 372.7

See application file for complete search history.

(56) References Cited

U.S. PATENT DOCUMENTS

| | | | | |
|---|---|---|---|---|
| 2,843,309 | A * | 7/1958 | Wheeler | 383/5 |
| 3,441,199 | A * | 4/1969 | Brockmuller | 383/44 |
| 4,373,979 | A * | 2/1983 | Planeta | 156/73.1 |
| 4,498,192 | A * | 2/1985 | Becker et al. | 383/126 |
| 2004/0136622 | A1 * | 7/2004 | Shigeta et al. | 383/120 |
| 2006/0269173 | A1 * | 11/2006 | Koehn | 383/120 |
| 2007/0274614 | A1 * | 11/2007 | Abel | 383/126 |

FOREIGN PATENT DOCUMENTS

| | | | |
|---|---|---|---|
| GB | 2208222 | A * | 3/1989 |

* cited by examiner

*Primary Examiner*—Jes F Pascua
(74) *Attorney, Agent, or Firm*—Hancock Hughey LLP

(57) ABSTRACT

A pinch bottom open mouth bulk material bag fabricated from polywoven material has closures at one or both ends that are non-sewn and which comprise a strip of tape running in the cross-bag direction. The tape is folded over the respective bag end, which may be modified, and is glued in place to close the end. The closure has no holes or other openings through which contaminants may enter the bag interior.

6 Claims, 8 Drawing Sheets

POLYWOVEN PINCH BOTTOM OPEN MOUTH BAG

FIELD OF THE INVENTION

This invention relates to bulk material bags fabricated from the raw material that is commonly referred to as "polylaminated" or "polywoven," and more specifically, to a pinch bottom open mouth bag fabricated from this material.

BACKGROUND

The so-called polylaminated or polywoven material that is widely used to fabricate bulk material bags comprises a single ply material that has two layers intimately bonded together so that the two layers appear and function as a single ply. The inner layer is a polywoven scrim layer and the outer layer is typically paper or polypropylene. During manufacture of the raw polylaminated sheet, the polywoven scrim is inseparably and intimately bonded to the outer paper or polypropylene. A variety of materials may be used to make polylaminated sheets. The inner polywoven scrim is a fabric material that is typically woven from a polypropylene or high density polyethylene thread. As noted, the outer layer is typically a kraft paper, but also may be a bio-oriented polypropylene or an oriented polypropylene (also known as synthetic paper). Regardless of the particular materials that are used, the inner scrim layer is inseparable from the outer layer. Sometimes an extruded polyethylene layer is laid down between the inner scrim layer and outer paper layer.

The raw polywoven sheet is formed into bulk material bags that are filled by the consumer. A variety of bulk material bags may be formed, but typically the bags are of the "sewn open mouth" type. This type of a bag may or may not have side gussets, but in either case one end of the bag is typically sewn closed and the bag is shipped from the manufacturer to the user empty, in a flattened condition. The user fills the bag with bulk material such as pet food, agricultural commodities, chemicals and the like through the open top, and the open top is then sewn closed by the consumer, resulting in an efficient bag that is generally suitably strong.

While sewn closures on both ends of a sewn open mouth polywoven bag are an industry standard, such closures have inherent limitations. For example, sewn closures inherently introduce holes in the bag. Holes can be a problem because they present an entry route for insects and other contaminants. Insect contamination in bulk bags containing pet food is a notorious problem. Just as well, other contaminants are able to enter the interior of a bag through the holes sewn through the bag in sewn closures. A folded-over closure is not an option with current sewn open mouth polywoven bags because the open top of the bag has only exposed paper on the outer layer. If the open end is folded over there is no material that could be bonded together. While a stepped end could be a possible solution to this problem with raw materials other than polywoven, a stepped open end is not an option with polywoven material because the way in which the raw sheets are manufactured. It is possible for a user to melt the polywoven material together in a heated band sealer, but this type of closure requires specialized equipment that most users do not have access to, and may not be an adequate solution where the material in the bag is powdery and powder covers the polywoven material. Moreover, sealing a polywoven bag with heat is not an ideal closure because it is difficult to control the amount of melted material that forms the seal, and there may be leaks and or overheating, which could lead to cracks. Finally, while sewn closures have adequate strength for most uses, the pinch bottom closures provide a seal without sifting.

Accordingly, in view of the shortcomings inherent in conventional polywoven bags, there is an opportunity to supply a bag that has all of the advantages of conventional bags, yet avoids the shortcomings.

SUMMARY OF THE INVENTION

The illustrated embodiments of the present invention are a polywoven bag having non-sewn end closures with no holes through which contaminants may enter the bag. A first end—the manufactured end—is closed by the manufacturer. The bag with one closed end is sent to the customer with one open end. After the customer fills the bag, the second end is closed by the customer.

The end closures comprise a tape member applied to one main panel of the bag at the open end. The tape member extends in a cross-bag direction across the entire width of the bag and has adhesive applied to a surface that is folded over the open end so that the tape member adheres to desired surfaces of the opposite main panel, which may preferably be modified to accept the tape. The bag thus closed has no openings for entry of contamination. The bag is further easier to close than sewn closures and is a replacement for multiwall paper pinch bottom bags.

BRIEF DESCRIPTION OF THE DRAWINGS

The invention will be better understood and its numerous objects and advantages will be apparent by reference to the following detailed description of the invention when taken in conjunction with the following drawings.

FIGS. 2 through 5 are a series of sequential illustrations of a bag blank used to manufacture a single bag according to present invention, showing steps in the formation of the bag. In FIGS. 2 through 5 the "interior" or polywoven side of the blank is shown.

FIG. 2 is a plan view of a bag blank used to manufacture a single bag according to the present invention, showing various fold lines.

FIG. 3 is a plan view similar to FIG. 2, illustrating the fold lines shown in FIG. 2 and various slits formed in the bag blank.

FIG. 4 is a plan view showing the next sequential step in formation of a single bag, showing how sections of the material are folded-back upon themselves.

FIG. 10 is a perspective view of the second illustrated polywoven laminated to paper/poly pinch bottom open mouth bag having one end closure, specifically, the manufactured end, formed according to an alternative embodiment of the invention.

FIG. 11 is a perspective view showing the bag of FIG. 10 being prepared for closure with glue applied to a portion of the bag.

FIG. 12 is a perspective view that illustrates the next step in the sequence showing the bag being folded over to begin closure.

FIG. 13 is a perspective view showing addition of tape to the bag.

FIG. 14 is a perspective view showing how the tape is folded over the rest of the bag to close the end.

FIG. 15 is a perspective view in which the bag end is completely closed.

DETAILED DESCRIPTION OF THE PREFERRED EMBODIMENTS

Figure 1:
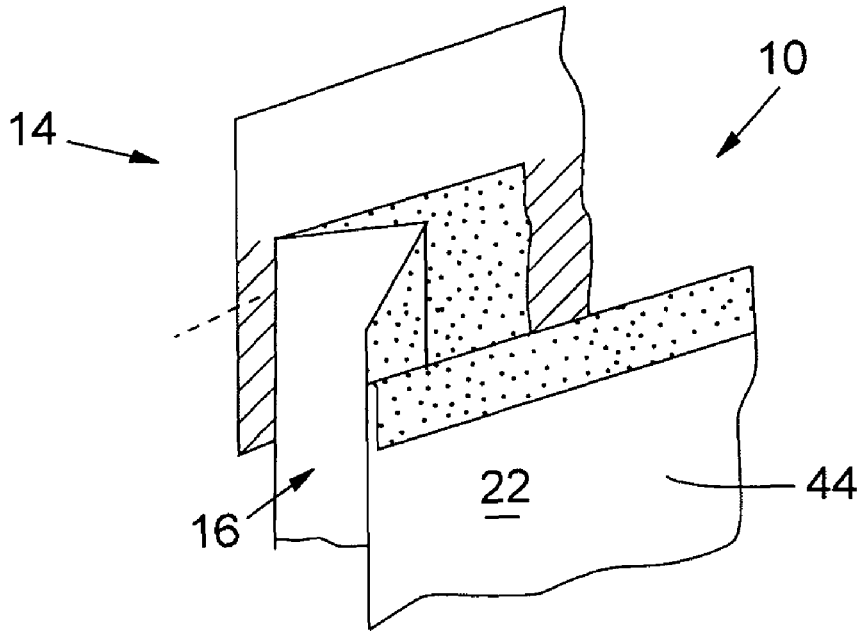
FIG. 1 is a perspective partially cut away view of an open end of a pinch bottom open mouth bag according to a first illustrated embodiment of the present invention, manufactured from a polywoven material.

As noted above, the pinch bottom open mouth ("PBOM") bag 10 according to the present invention is manufactured from a polywoven material, which is also sometimes called a polylaminated material. This material is well-known in the art and is used ubiquitously to manufacture sewn open mouth (SOM) bags. Again briefly described, the polylaminated or polywoven material is a single ply material that comprises two layers of material that are so intimately bonded together that the two layers define what is referred to in the industry as a single ply. The inner "layer" is a woven scrim of a polyethylene strand, and the outer "layer" is usually paper or polypropylene, although the outer layer may be other materials as well. The woven inner layer is inseparably bonded to the outer layer, as noted above, to define a single ply material. The inner scrim layer is polypropylene or high density polyethylene and the outer layer is typically a kraft paper, a bio-oriented polypropylene or a synthetic paper. The outer layers of such bags may be printed with high quality graphics and the like. Such bags are referred to in various ways herein, including "polywoven poly/paper" and "polylaminated paper/poly" bags. It will be appreciated therefore that the term "polywoven" is used herein to refer generally to materials comprising an inner woven layer of polyethylene and an outer layer of paper, polypropylene or other suitable materials.

Polylaminated paper/poly PBOM bags are shipped from the manufacturer to the users in a flattened condition with one end of the bag closed, and the opposite end open. In the present description, the closed end 12 of bag 10 is sometimes referred to as the "manufactured" end. The open end 14 is sometimes referred to as the "consumer" end because the open end is closed by the consumer after the bag is filled. From the description of the embodiment illustrated in FIGS. 1 through 9 that follows it will be appreciated that before one end of the bag is closed, both the closed end 12 and the open end 14 are structurally identical. As such, identifying one end as an open end and the other as closed is somewhat arbitrary. The embodiment illustrate in FIGS. 10 through 15 has different structure on the manufactured end from the consumer end, and is thus more amenable to a description of different ends.

Polylaminated paper/poly PBOM bags such as bag 10 according to the present invention may be manufactured with gusseted sides 16 as illustrated herein, or may just as well be made with flat sides. With the present invention, the manufactured end 12 and consumer end 14 are modified so that the ends are closed without a sewn closure, and such that the closure has no holes that might allow for ingress or egress of contaminants.

Reference is now made to the series of FIGS. 2 through 5, which show a single blank 18 of raw, unformed polywoven material that is used to form a single bag 10 according to the present invention. As noted above, the polywoven material is a single ply material that has a layer of woven fabric 20, which when the bag 10 is formed serves as the interior of the bag, and an outer layer that may be paper or polypropylene. For purposes of this description the outer layer 22 is assumed to be paper, although it is to be understood that outer layer 22 may just as well be polypropylene and other materials. In FIGS. 2 through 5 the blank 18 is shown with the woven fabric layer 20 oriented toward the viewer. The outer layer 22 is not shown in FIGS. 2 through 5, but is shown in other views.

The single blank 18 in FIGS. 2 through 5 is shown in a planar condition prior to its being formed into a tube. For reference purposes, the bag axis is defined as the axis extending in the direction of arrow A—that is, the axis that extends along the longitudinal axis of the formed bag. The cross-bag axis is transverse to the bag axis. It will be appreciated that continuous roll stock material is used to form a continuous sheet of polywoven blank in which the outer paper layer is adhered inseparably to the woven inner layer as described above. The opposite lateral edges of the woven fabric layer 20 are identified as edges 24 and 26. The paper layer 22 is slightly narrower in the cross-bag direction from the inner layer 22. Thus, as the roll stock material is laid down, one edge of the paper layer 22 is aligned with edge 24 of the inner woven layer 20, and the opposite lateral edge 28 of the paper layer 22 is stepped slightly inwardly relative to edge 26 of inner layer 20. Edge 28 is shown in dashed lines in FIGS. 2 through 5.

As noted, bag 10 may be manufactured with gusseted sides or flat sides, and in the embodiments illustrated herein the sides are gusseted. Specifically, gusset fold lines 30, 32, 34, 36, 38 and 40 are formed in blank 18 extending along the bag axis direction. In the drawings accompanying the present description, unless otherwise noted, fold lines are shown in dashes, and slits are shown as solid lines. The gusset fold lines define the two major panels in the finished bag, identified herein as a front panel 42 and a rear panel 44. It will be appreciated that referencing the major body panels as being either "front" or "rear" is arbitrary and is done here only for purposes of explaining the invention. In any case, when the polywoven material is in the form of a blank 18, rear panel 44 is divided into two sections, one on either side of front panel 42 in blank 18, so that when the blank is formed into a tube the rear panel sections 44 at opposite sides of the front panel are overlapped and sealed so that a seam extends along the rear panel in the bag axis direction. It will also be noted that if the bag were manufactured with flat sides rather than gussets, the three gusset fold lines on both sides of the bag would be replaced with a single fold line.

Figure 3:
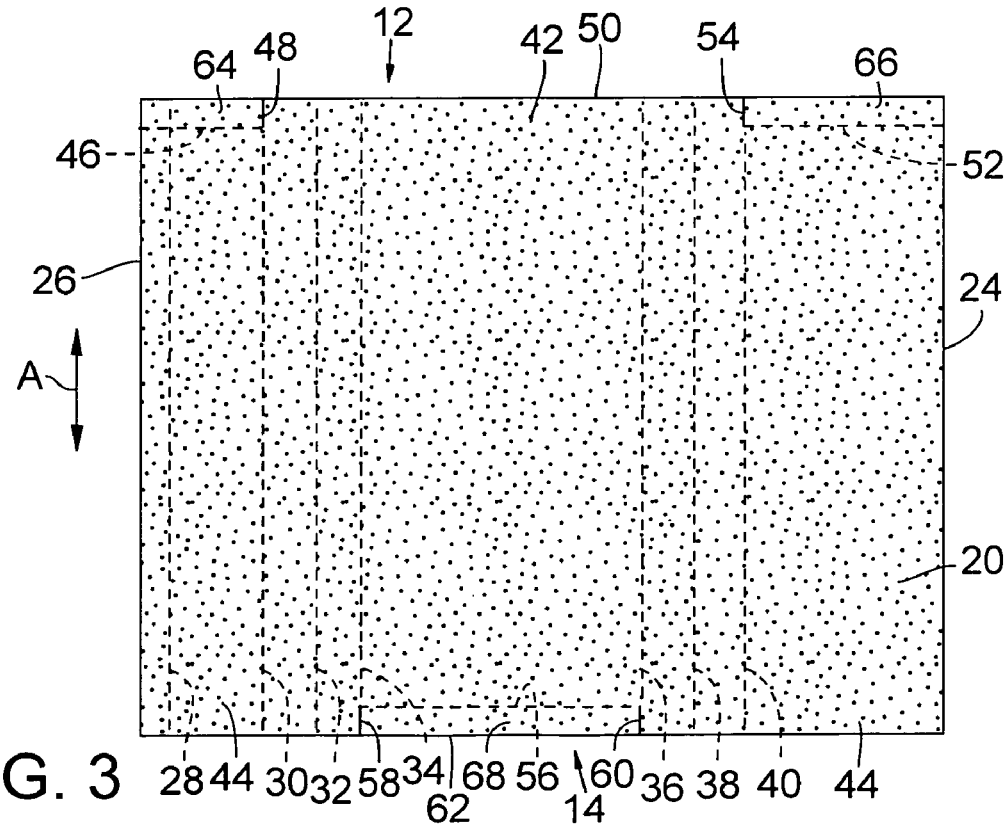

With reference now to FIG. 3, a series of fold lines and slits are formed at both ends of blank 18. Specifically, a fold line 46 is formed in the cross-bag direction from lateral edge 26 to gusset fold line 30 in one section of what will become rear panel 44. A slit 48 is cut through the blank extending from the end of fold line 46 at gusset fold line 30 to the edge 50. Similarly, a fold line 52 is formed in the cross-bag direction from lateral edge 24 to gusset fold line 40 in the opposite section of what will become rear panel 44. A slit 54 is cut through the blank 18 extending from the end of fold line 52 at gusset fold line 40 to edge 50. At the opposite end of blank 18 a fold line 56 is formed in the cross-bag direction completely across front panel 42 extending between gusset fold lines 34 and 36. A slit 58 is cut through the blank 18 extending from the end of fold line 56 at gusset fold line 34 to edge 62, and a slit 60 is similarly cut through the blank from the opposite end of fold line 56 at gusset fold line 36 to edge 62.

Figure 6:
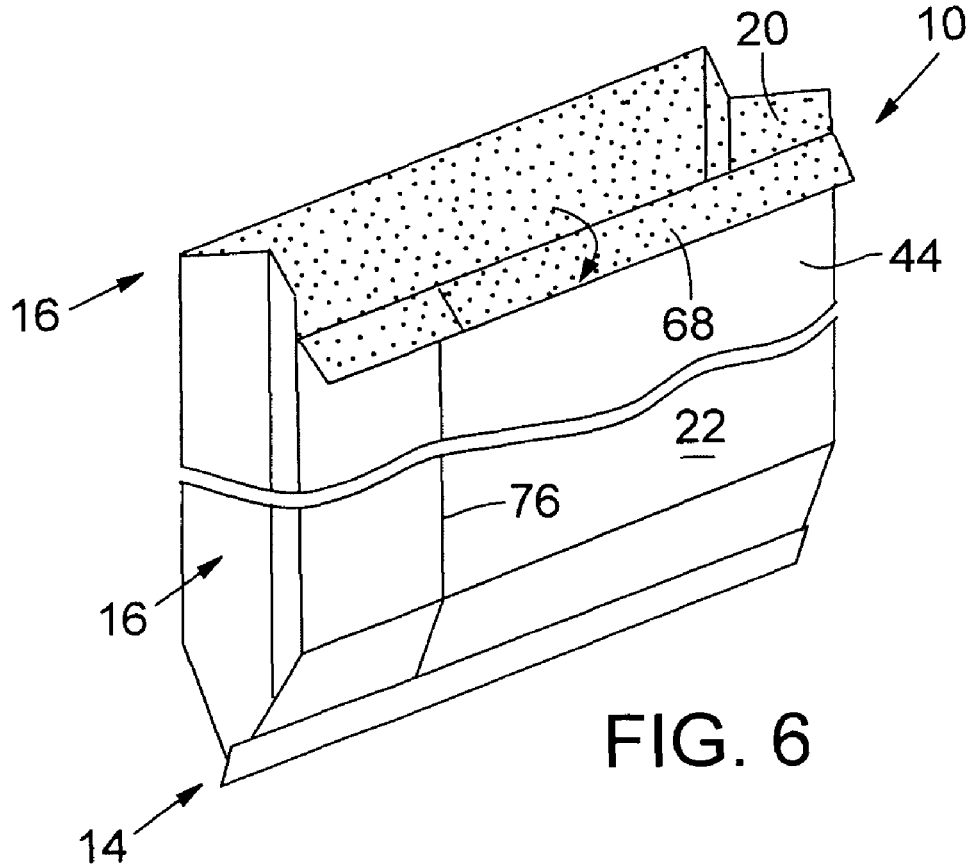
FIG. 6 is a perspective view of a polywoven laminated to paper/poly pinch bottom open mouth bag according to the present invention, showing one end of the bag closed and the opposite end open, in which the tape has been removed to illustrate the structure of the bag.
Figure 2:
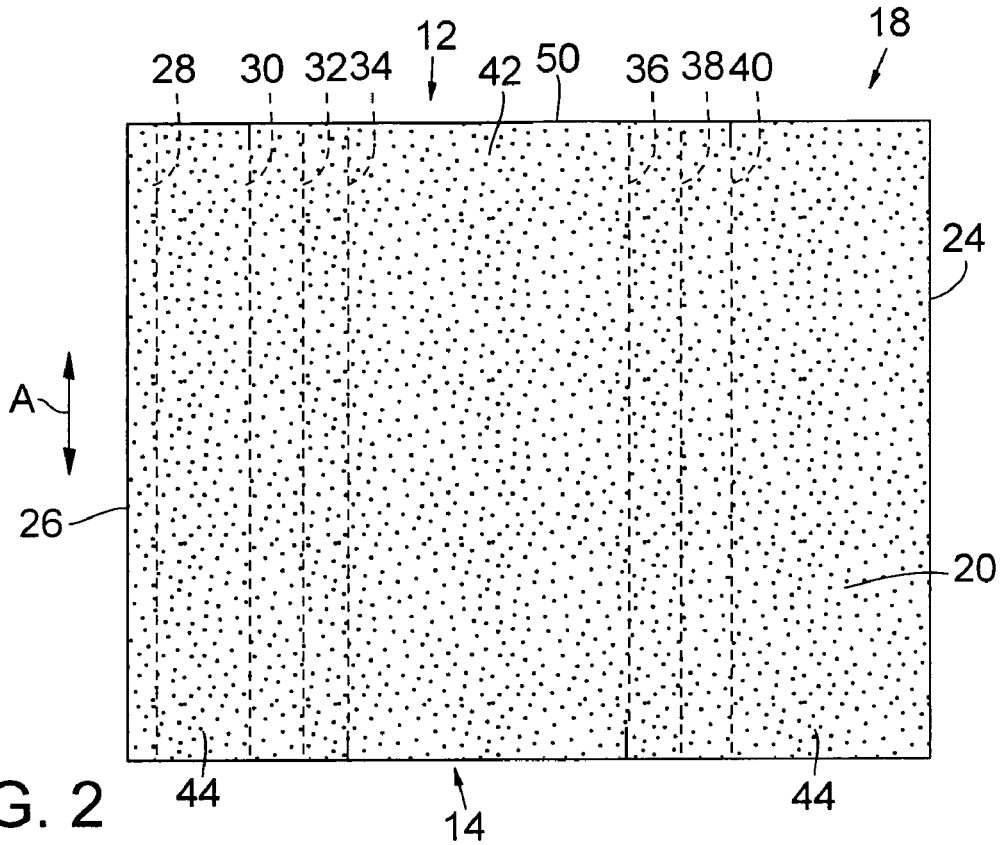
Figure 4:
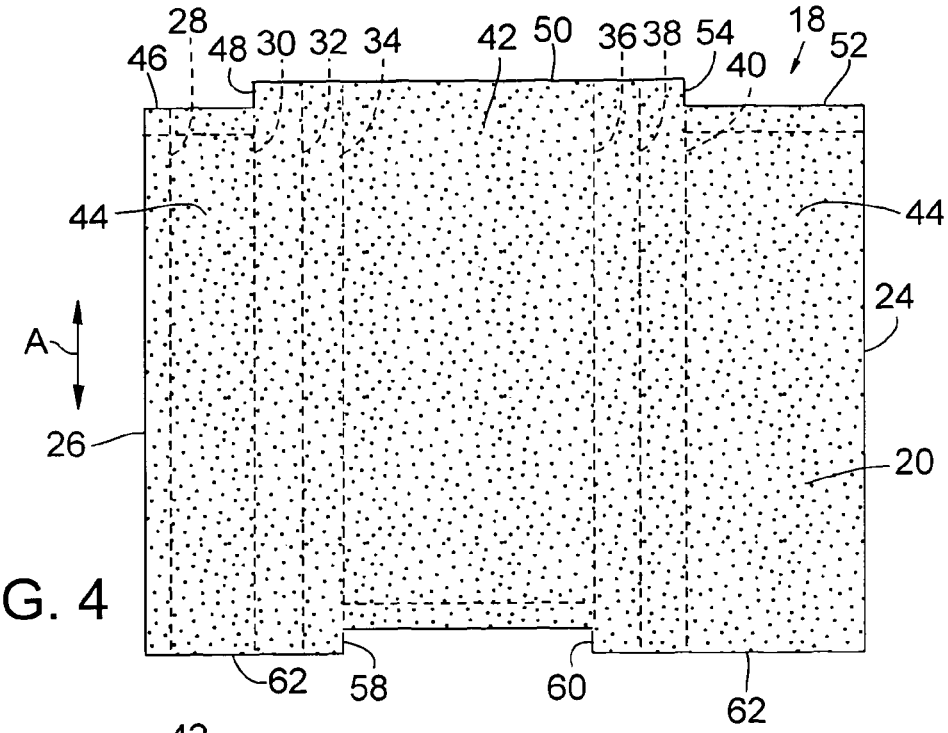

The fold lines and slits just described define three different flaps, referenced on FIG. 3 as flaps 64 and 66 at end 50, and flap 68 at end 62. Turning to the next illustration in sequence, FIG. 4, the flaps 64, 66 and 68 are folded over at the fold lines that define the flaps, into the plane of the paper of the drawings. Specifically, flap 64 is folded over at fold line 46 so that the paper layer 22 side of the flap faces the paper layer 22 side of the panel 44. Stated another way with reference to the drawing sheets, the flap 64 is folded into the plane of the drawing sheet. Adhesive is applied to the facing paper surfaces, that is, to that surface of paper layer 22 on flap 64 so that the flap is glued down as shown in FIG. 4. The same process is applied to flaps 66 and 68, which are thus folded over at the respective fold lines that define the flaps and the flaps are glued paper layer-to-paper layer. FIG. 6 illustrates schematically folding flap 68 over and adhering the paper side of the flap to paper layer 22 of the rear panel 44.

Figure 5A:
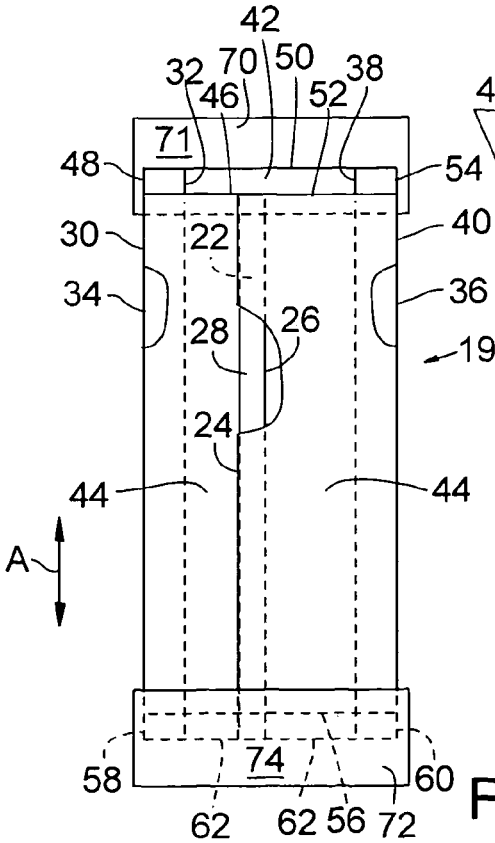
FIG. 5A is a plan, partially cut away view of the blank shown in FIGS. 2 through 4 after the blank has been formed into a tube.
Figure 5B:
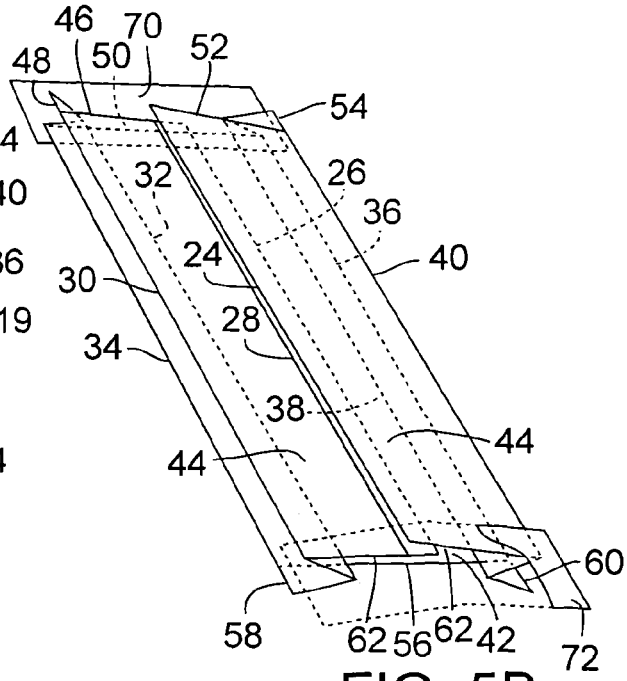
FIG. 5B is a perspective view of the tube shown in FIG. 5A, illustrating some of the fold lines in dashed lines to illustrate how the tube is formed.

At this point blank 18 is ready to be formed into a tube 19 as illustrated in FIGS. 5A and 5B. This is done by folding the blank at gusset fold lines 30, 32 and 34 to form a gusset, as illustrated with the gusset 16 shown in FIG. 6 on one lateral edge of the blank, and folding the blank at gusset fold lines 36, 38 and 40 to define an identical gusset at the opposite lateral edge of the blank. The actual tube having open opposite ends is formed by folding the blank inwardly at gusset fold lines 30 and 40 so that the lateral edge 24 overlaps lateral edge 28 of paper layer 22. Because lateral edge 28 of paper layer 22 is stepped inwardly from lateral edge 26 of woven layer 20, when the tube is thus formed, there is a facing strip of woven material running in the bag axis direction along the entire length of the now-formed tube. Moreover, there is a slight overlap of the woven layer 20 that overlaps the edge 28 of paper layer 22 along the entire length of the bag. The overlapping edges are adhered to one another in an appropriate manner, for example with glue, sonic welding, and/or with heat sealing to define a seam 76 that runs along the length of the bag in the bag axis direction (see e.g., FIG. 6).

With continuing reference to FIGS. 5A and 5B, in the next sequential step in formation of bag 10, separate strips of tape are glued to the ends of the tube 19 in order to form the end closure mechanism. First, tape 70 is glued to the paper layer 22 side of blank 18 so that the tape extends completely across front panel 42, running transverse to the bag axis (arrow A). Because the length of tape 70 is slightly longer than the width of the front panel 42, the tape extends over the gusset fold lines on either side of the front panel. The tape 70 thus overlaps and extends beyond the gusset fold lines 34 and 36, and 30 and 40. Further, the tape is adhered to the front panel such that a section of the tape, referred to herein as exposed section 71, extends beyond edge 50. Glue is applied to tape 70 over the entire surface of the tape that contacts the paper layer 22 side of the blank.

Next, tape 72 is glued to the opposite longitudinal end of tube 19 across rear panel 44 so that the tape extends completely across rear panel 44, running transverse to the bag axis (arrow A). Because the length of tape 72 is slightly longer than the width of the rear panel 44, the tape extends over the gusset fold lines on either side of the rear panel. The tape 72 thus overlaps and extends beyond the lateral edges defined by the gusset fold lines 34 and 36, and 30 and 40. As with tape 70, tape 72 is adhered to the rear panel 44 such that a section of the tape, referred to herein as exposed section 74, extends beyond edge 62. Glue is applied to tape 72 over the entire surface of the tape that contacts the paper layer side of the tube 19. Stated another way, there is glue applied to the entire mating surfaces between the tape and the tube.

A variety of materials may be used for the tape used for 70 and 72, including kraft paper of various weights, for example 80 lb. A variety of other materials could just as well be used for the tape, including poly-coated kraft paper, polywoven material, and other materials.

Figure 7A:
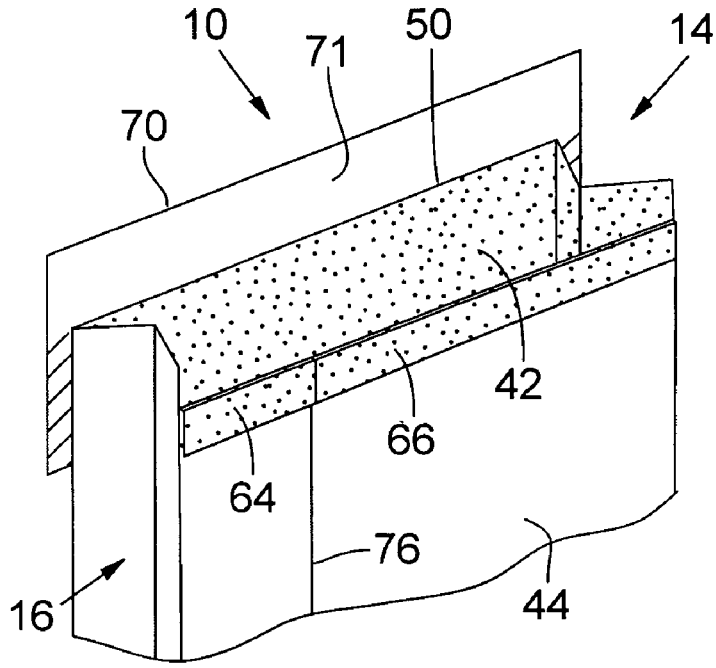
FIG. 7A a perspective view of one open end of the polywoven laminated to paper/poly pinch bottom open mouth bag according to the present invention, prior to adhesive being applied to the closure section.
Figure 7B:
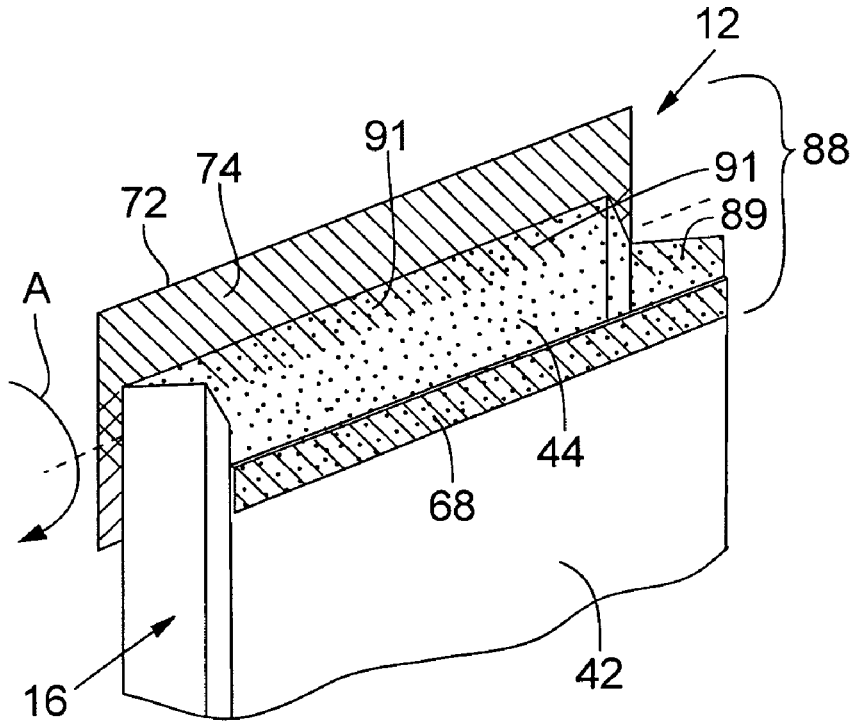
FIG. 7B is a perspective view of the opposite open end of the polywoven laminated to paper/poly pinch bottom open mouth bag shown in FIG. 7A, with adhesive applied to the closure section.

FIGS. 7A and 7B show opposite ends of the open tube prior to one end being closed. As shown in FIG. 7A, when the seam 76 is formed in this manner, flaps 64 and 66 align with one another in the cross-bag direction. The tapes 70 and 72 are now in a position such that the ends of the bag are ready for further operations facilitating closure.

The tubular blank 19 thus formed has open opposite ends—i.e., the manufactured end 12, and the opposite end. The manufactured end 12 will be closed by the manufacturer, and the opposite end, consumer end 14, will remain open for later closing by the customer. It will be appreciated that prior to one end being closed, both ends of the bag 10 are essentially identical in structure, with the exception being that the folded-over flaps 64 and 66 are oriented toward and adhered to rear panel 44, whereas folded-over flap 68 is oriented toward and adhered to front panel 42.

Figure 8:
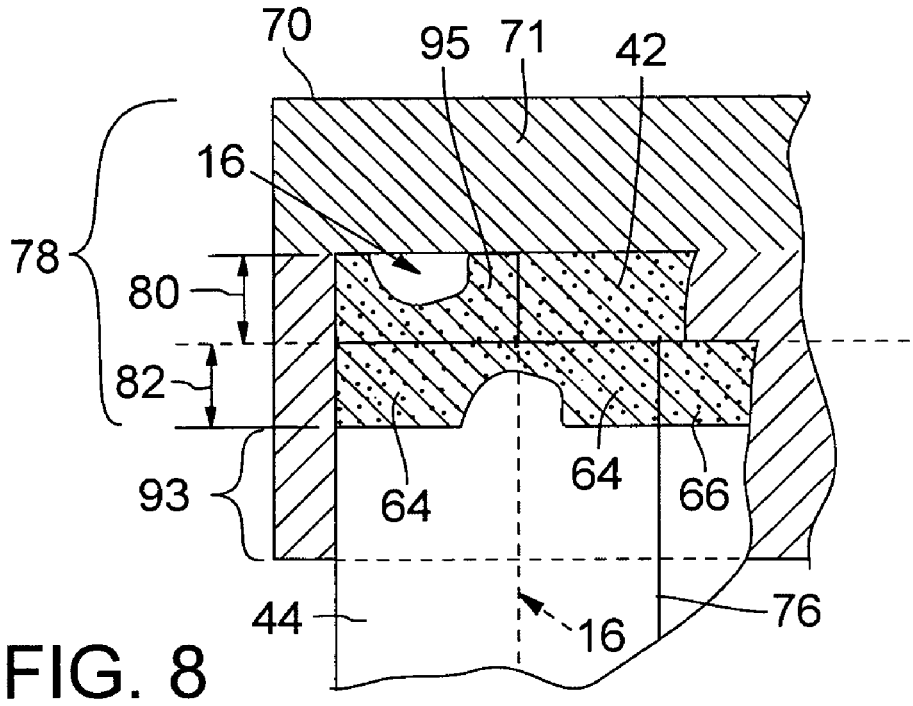
FIG. 8 is a partially cut away plan view of one corner of an open end of a polywoven laminated to paper/poly pinch bottom open mouth bag according to a first illustrated embodiment of the present invention, manufactured from a polywoven material.
Figure 9:
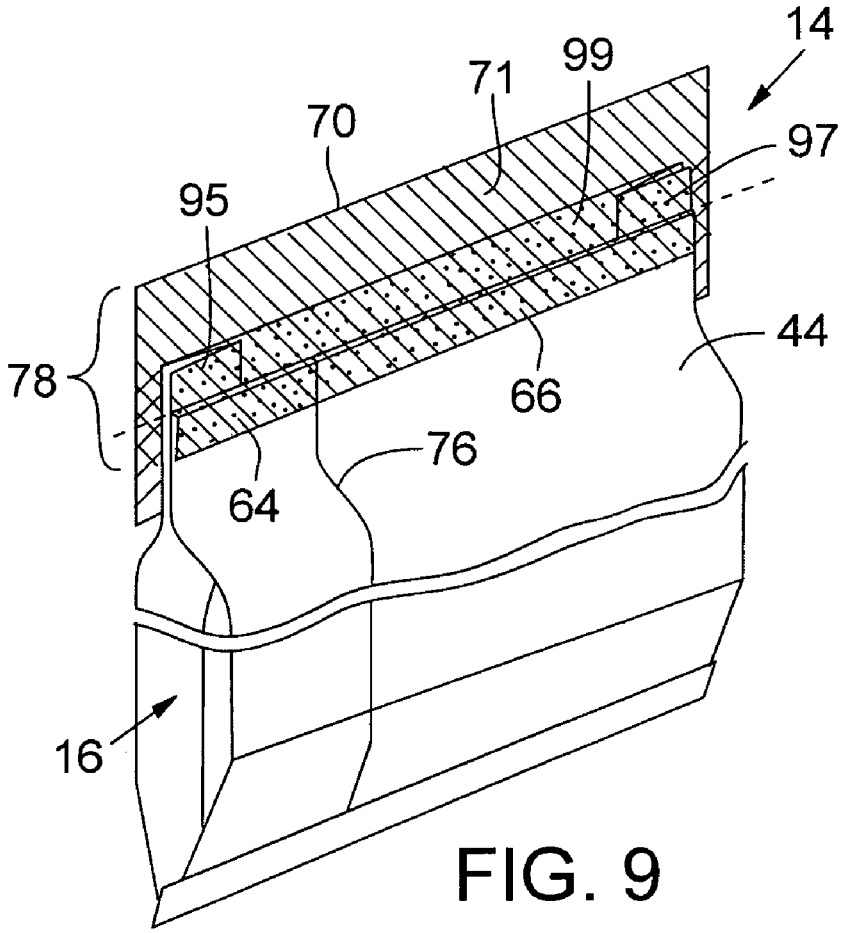
FIG. 9 us a perspective view of the bag illustrated in FIG. 7, showing the end of the bag being prepared to be closed by the consumer.
Figure 10:
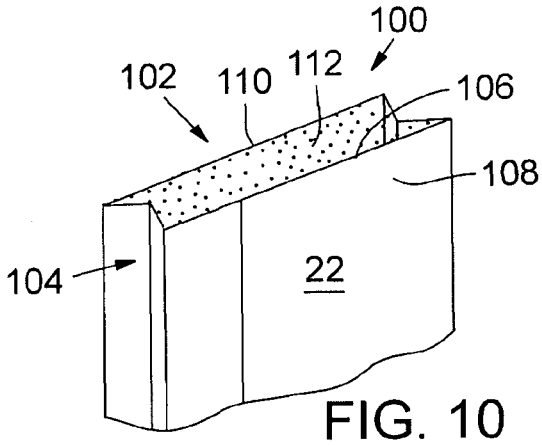
FIGS. 10 through 15 are a sequential series of illustrations showing a polywoven laminated to paper/poly pinch bottom open mouth bag according to the present invention in which the manufactured end of the bag is closed according to an alternative embodiment the present invention.

At this point the formed tube is laid flat and adhesive is applied to desired exposed portions of the bag at each end to facilitate closing of the ends. With reference to FIGS. 8 and 9, when the bag is in this position a closure section 78 is defined as that portion of the bag including an upper portion of tape 70, an exposed strip 80 comprising a section of gusset 16 and front panel 42, and an exposed strip 82 comprising the folded over and thus exposed flaps 64 and 66. An adhesive such as hot melt adhesive that will not be tacky when dry, yet is able to be adhered later, is applied to the entire exposed surfaces of closure section 78. Thus, adhesive is applied to the exposed portion 71 of tape 70, the exposed strip 80 and the exposed strip 82. The glue, which is illustrated with diagonal lines, is allowed to dry.

Referring to FIG. 7B, an analogous closure section 88 is formed at the opposite end of the tube (closed end 12), comprising the exposed section 75 of tapes 72, two exposed strips of gusset 16 (one of which is shown in FIG. 7B and identified with number 89), an exposed strip of rear panel 44 (identified with number 91), and the strip of folded over and glued-in-place flap 68. Glue is applied to closure section 88 and the glue, again illustrated with diagonal lines.

Manufactured end 12 is then closed by folding the exposed portions of tape 72 over the open end of the tube in the direction of arrow A in FIG. 7B. As this is done, the exposed portion 74 of tape 72, which as noted is coated with hot melt adhesive, covers and comes into contact with the two exposed strips of gusset 16 (i.e., strip 89 and the strip on the opposite gusset), exposed strip 91 of rear panel 44, and flap 68, all of which also have been coated with hot melt adhesive. Moreover, when folded over in this manner, a strip of tape 72 covers a strip of the outer paper layer 22 of front panel 42—this strip is not shown in FIG. 7B but the analogous strip on the opposite end of the bag is illustrate in FIG. 8 and is described below with respect to open end 14. The thus folded-over tape is pressed under heat against the facing portions of bag 10 and the surfaces are held together until they are joined firmly. Portions of tape 72 that extend beyond the lateral side edges of the bag may optionally be trimmed if desired. There are no holes or other openings through which contaminants may reach the interior of the bag.

The opposite end, which will now be referred to as open end 14, is not closed by the manufacturer, but is instead closed by the consumer after the bag is filled by the customer. The configuration of open end 14 is shown in detail in FIG. 8. After the consumer fills the bag, tape 70 is folded over the rear panel 44 by folding tape 70 at edge 50 (see FIG. 7A). In the context of the illustration of FIG. 8, tape 70 is folded out of the plane of the page and is folded over the rear panel 44. With tape 70 folded onto rear panel 44, the exposed portion 71 of the tape, which as described above is coated with hot melt adhesive, covers and comes into contact with the two exposed strips of gusset 16, identified as strips 95 and 97 in FIGS. 8 and 9, exposed strip 99 of rear panel 44, and aligned flaps 64 and 66, all of which also have been coated with hot melt adhesive. Further, when tape 70 is folded over in this manner, an edge strip of tape 70 extends over and covers a portion of the outer paper layer 22 of front panel 42 below the lower edge of flaps 64 and 66. This glued paper-to-paper section is identified in FIG. 8 as section 93. As with manufactured end 12, the thus folded-over tape 70 is pressed under heat against the facing portions of bag 10 and the surfaces are held together until they are joined firmly together. Portions of tape 70 that extend beyond the lateral side edges of the bag may be trimmed if desired.

Many consumers have equipment on hand that is used to close conventional "pinch bottom bags," and which is commonly referred to as a pinch bottom bag closure machine. Briefly described, these machines heat the open ends of pinch bottom bags, fold the bags over and squeeze the folded over portions to seal the end. This identical machinery may be used to close the consumer end of the bag 10 according to the present invention. As such, most customers will be able to utilize and close the bag 10 according to the present invention without purchasing added equipment.

The bag 10 with both ends thus closed has no holes or other openings through which contaminants may reach the interior of the bag. The tape 70 and 72 thus define closure strips or members that facilitate an improved manner of closing the bag.

An alternative illustrated embodiment is shown in the series of FIGS. 10 through 17. In the embodiment shown in FIGS. 10 through 15 only one end of the bag 100 is shown, and specifically, the end that is shown is closed end or "manufactured end 102." The embodiment illustrated in these figures has an open consumer end on the opposite end of the bag 100 that is fabricated as described above with respect to FIGS. 1 through 9. Accordingly, the embodiment of closure described with respect to FIGS. 10 through 15 applies only to the manufactured end, and not to the open consumer end.

Figure 11:
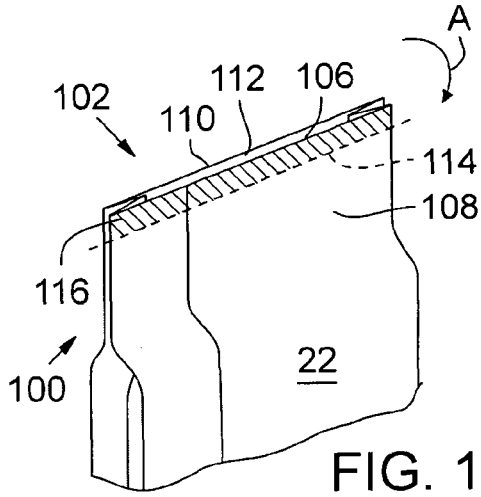
Figure 12:
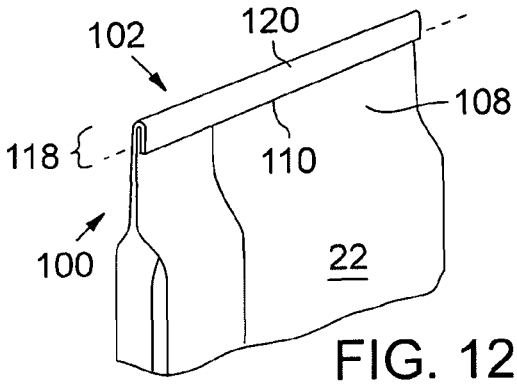

Bag 100 is the same style bag as bag 10 of FIGS. 1 through 9, and includes a gusseted side wall with gussets 104. The blank that is used to form bag 100 is cut so that the upper edge 106 of front panel 108 is collinear with the upper edge 110 of rear panel 112. Accordingly, when the front panel 108 and rear panel 112 are flattened together as shown in FIG. 11, top edges 106 and 110 align across the entire lateral width of the bag (i.e., in the cross-bag direction).

Figure 13:
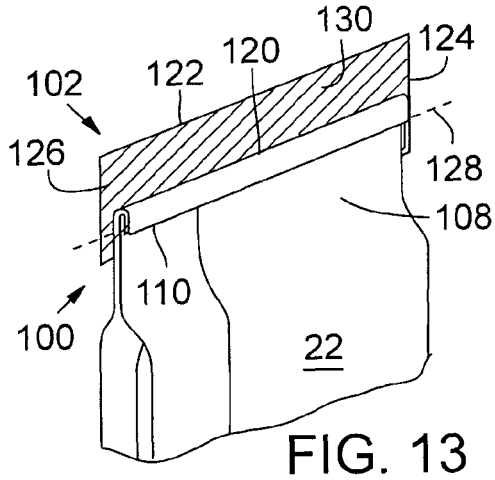

A fold line 114 is formed laterally across bag 100 a short distance below aligned top edges 106 and 110 and adhesive (such as hot melt glue) is applied to the strip 116 defined between fold line 114 and top edge 106. The top edge of the bag is then folded over as shown with arrow A in FIG. 11 so that there is a doubled-over strip 118 where the paper layer of bag 100 is glued to the paper layer. The newly formed upper edge of bag 100 is labeled with reference number 120. Next, with reference to FIG. 13, a strip of tape 122, identical to tape 70 described above, is glued to rear panel 112 such that the opposite ends 124 and 126 of tape 122 extend slightly past the lateral side edges of bag 100, and so that a width of the tape extends upwardly past upper edge 120 of the bag, as shown in FIG. 13 and defines an exposed portion 130.

A fold line 128 is defined in the cross-bag direction at the edge 110.

It will be appreciated that the one entire side of tape 122 may be coated with hot melt adhesive prior to gluing the tape to bag 100. When hot melt adhesive is applied to tape 122, the tape is adhered to bag 100 with heat and pressure.

Figure 14:
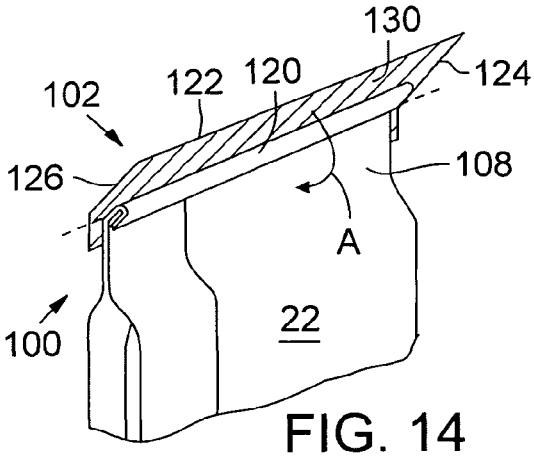
Figure 15:
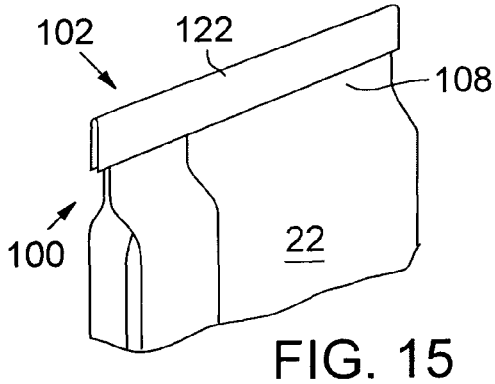

Turning now to FIG. 14, tape 122 and bag 100 are folded over at fold line 128 in the manner illustrated with arrow A. As this is done, the exposed portion 130 of tape 122, which as noted is coated with hot melt adhesive, covers and comes into contact with the outer surface of bag 100 across the width of front panel 108. The thus folded-over tape is pressed under heat against the facing portions of bag 100 and the surfaces are held together until they are joined firmly together. Fold lines 114 and 128 are sealed completely with tape 122. Portions of tape 122 that extend beyond the lateral side edges of the bag may be trimmed if desired. The closure has no holes or other openings through which contaminants may reach the interior of the bag.

The opposite end of bag 100 has a closure such as that described above with reference to FIGS. 1 through 9, which the consumer closes in the manner described after the bag has been filled.

From the foregoing description and the drawing figures it will be appreciated that certain modifications to the invention may be made. As one example, because the closure described herein is easier for the consumer to close and eliminates the need for sewing equipment, it is possible for a bag to have the manufactured end closed with a conventional sewn closure and the consumer end to have a closure as described herein. It is just as possible to have one end of a bag having a closure of the type described with reference to FIGS. 1 through 9, and the opposite end manufactured with the closure described in FIGS. 10 through 15.

Figure 16:
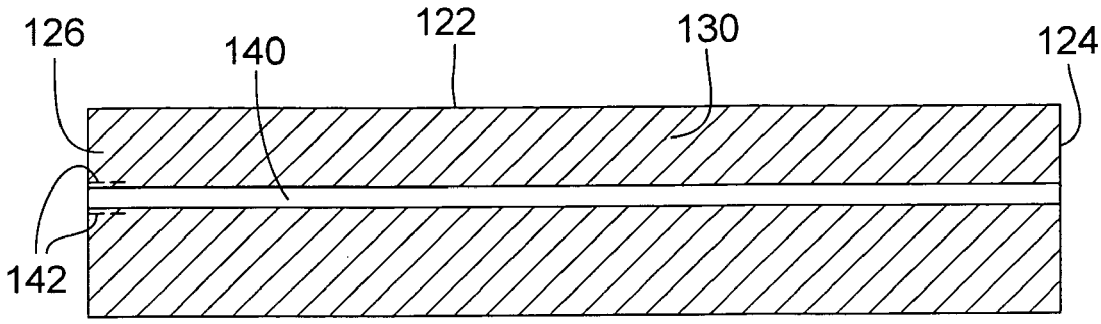
FIG. 16 is a plan view of tape used in the present invention and illustrating a pull strip added to the tape to facilitate opening by the consumer.
Figure 17:
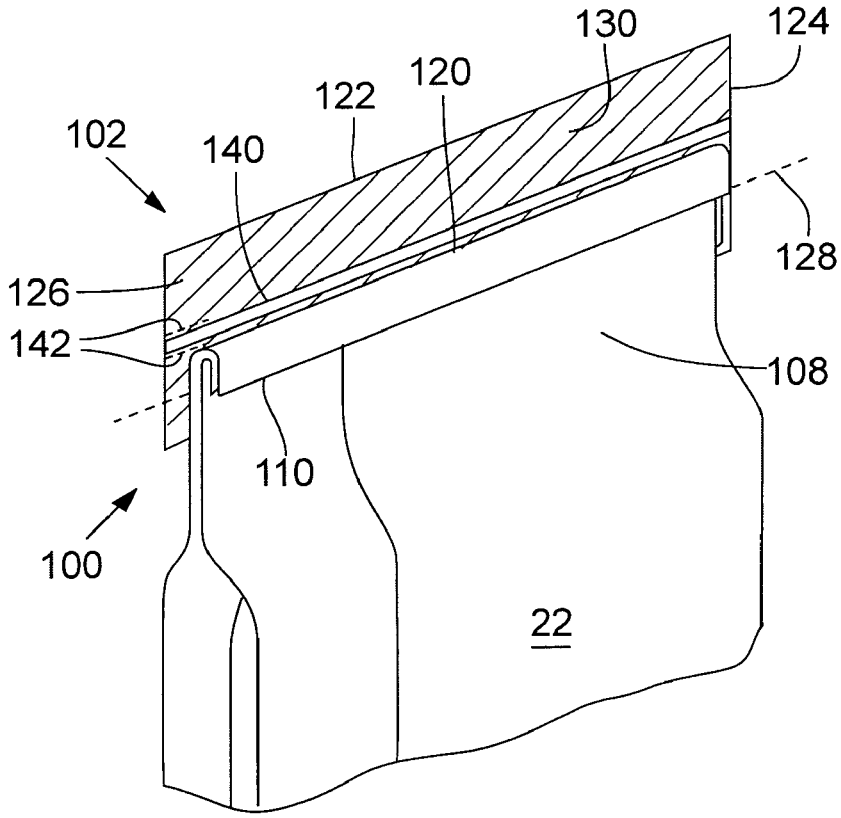
FIG. 17 is a perspective view of a bag incorporating the tape shown in FIG. 16 with the pull strip.

With reference to FIGS. 16 and 17, a pull strip 140 has been applied to tape 126 and the tape 126 has been perforated or scored 142 a short distance on either side of pull strip 140 at one end of the strip. Pull strip 140 is a flexible plastic strip or equivalent material that is adhered to the "interior" side of tape 126—that is, the side of the tape that faces the bag 10 when the bag is closed. The pull strip 140 is accessible to the consumer by virtue of the perforations 142 so that the consumer may easily pull the pull strip 140 and thereby tear tape 126 along its entire length to facilitate opening the bag. Because as noted above the closure illustrated in FIGS. 10 through 17 is used only on the manufactured end, it will be appreciated that when a bag incorporates a pull strip 140 as described, the manufactured end will be the end that is opened by the ultimate consumer to empty the contents from the bag.

Yet another alternative embodiment of a bag 200 is shown in FIGS. 18 through 21. In the embodiment of these figures the material used to form the bag has been modified slightly, as detailed below, yet the bag remains a polylaminated paper/poly PBOM bag equivalent to bag 10 described above. Thus, bag 200 may be manufactured with gusseted sides as described above, or may be made with flat sides. And as with the prior embodiments, the manufactured end consumer end are fabricated so that the ends are closed without a sewn closure, and such that the closure has no holes that might allow for ingress or egress of contaminants.

Figure 18:
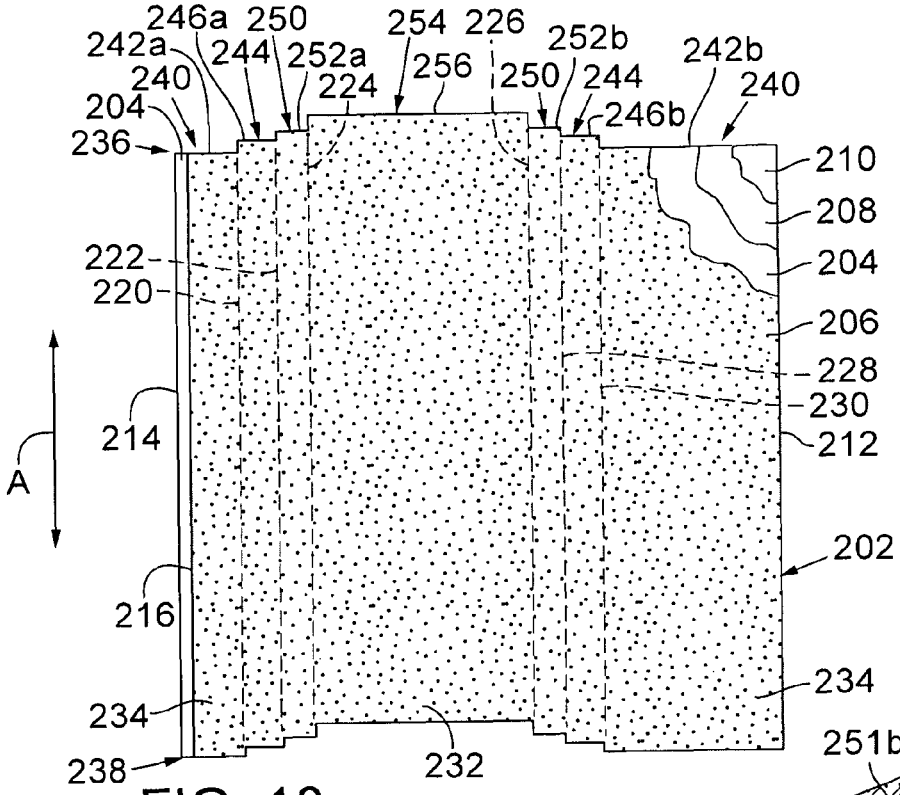
FIG. 18 is a plan view of an alternative embodiment of a bag blank that may be used to manufacture a single bag according to an alternative embodiment of the present invention, showing various fold lines, with a portion of various layers of the blank cut away.

Reference is now made to FIG. 18. A single blank 202 of flattened, unformed polywoven material that is used to form a single bag 200 is shown. In this case the polywoven material is a single ply material in which the layer of woven fabric 204 is coated with a plastic sheet or coating 206, which when the bag 200 is formed serves as the interior of the bag. It will be appreciated therefore that in the view of FIG. 18, the side of the blank 202 that is toward the viewer will eventually be the interior of bag 200. Blank 202 includes a layer 208 that may be paper or polypropylene and for purposes of this description the layer 208 is assumed to be paper, although it is to be understood that layer 208 may just as well be polypropylene and other materials. Blank 202 is illustrated in FIG. 18 with an optional plastic sheet or coating 210 that defines the outer surface of the finished bag 200. While coating 210 is optional, where used it provides protection for paper/poly layer 208 from moisture and soiling.

The single blank 202 in FIG. 18 is shown in a planar condition prior to its being formed into a tube. As noted above with reference to prior embodiments, the bag axis is defined as the axis extending in the direction of arrow A—that is, the axis that extends along the longitudinal axis of the formed bag. The cross-bag axis is transverse to the bag axis.

Continuous roll stock material is used to form a continuous sheet of polywoven blank in which the layers shown in FIG. 18 are adhered inseparably to one another. The opposite lateral edges of the blank 202 are identified as edges 212 and 214. The woven fabric material that is used for layer 204 is slightly wider than the layers of other material. As a result, at lateral edge 212 all of the layers in blank 202 are aligned. However, a narrow strip of the woven fabric layer 204 extends beyond the edge 216 of the remaining layers, in which the layers 206, 208 and 210 are aligned. Stated another way, the layers 206, 208 and 210 are of identical widths (in the cross bag direction), but are slightly narrower than woven fabric layer 204.

As noted, bag 200 may be manufactured with gusseted sides or flat sides, and in the embodiments illustrated herein the sides are gusseted. Specifically, gusset fold lines 220, 222, 224, 226, 228 and 230 are formed in blank 202 extending along the bag axis direction. In the drawings accompanying the present description, unless otherwise noted, fold lines are shown in dashes, and slits are shown as solid lines. The gusset fold lines define the two major panels in the finished bag, identified herein as a front panel 232 and a rear panel 234. Rear panel 234 is split into two sections while the blank 202 is in the flattened condition of FIG. 18, one on either side of front panel 232 in blank 202, so that when the blank is formed into a tube the rear panel sections 234 at opposite sides of the front panel are overlapped and sealed so that a seam extends along the rear panel in the bag axis direction. It will also be noted that if the bag were manufactured with flat sides rather than gussets, the three gusset fold lines on both sides of the bag would be replaced with a single fold line. As noted above, referencing the major body panels as being either "front" or "rear" is arbitrary and is done here only for purposes of explaining the invention.

The raw material that is used to form blank 202 is supplied from a continuous roll stock. Rotating drum knives perforate the roll stock into a series of connected blanks that have the structure shown in blank 202, and which are eventually separated from one another by pulling the individual units (i.e., blanks 202) apart. The blank 202 has linear opposite side edges (212, 214), but the end edges are cut so that there are steps formed. Specifically, the blank 202 has a first edge 236 extending in the cross bag axis direction, and a second edge 238 at the opposite end of the blank, also extending in the cross bag direction. With reference to first edge 236, a first step 240 is defined by edges 242*a* on the left side of FIG. 18, and a corresponding edge 242*b* at the right side of the figure. A second step 244 is defined by edge 246*a* and corresponding edge 246*b*. A third step 250 is likewise defined by edges 252*a* and 252*b*, and a final step 254 is defined completely across front panel 232 at edge 256. It may be seen that step 244 is defined across portion of blank 202 between gusset fold lines 220 and 222 on the left side of the figure, and that on the right side of the figure step 244 is that portion of blank 202 between gusset fold lines 228 and 230 at edge 236. Step 250 is defined as the portion of blank 202 between gusset fold lines 222 and 224 on the one side, and gusset fold lines 226 and 228 on the other side (at edge 236), and step 254 is the portion of blank 202 that extends across the front panel 232 at edge 236.

Examination of FIG. 18 will reveal that identical steps are formed at the opposite end of blank 18, along edge 238, with the exception that the steps extend inwardly toward the center of the blank. As noted, rotating knives cut the continuous roll stock into a series of connected individual blanks. The continuous sheet of individual blanks is formed into a tube, as detailed below. The continuous tube formed in this manner is separated into individual tubular units by pulling the units from one another at the perforations. At this stage, both open ends of the tube are identical in structure. Accordingly, the structure of the closure portion is detailed here only with respect to edge 236.

Figure 19:
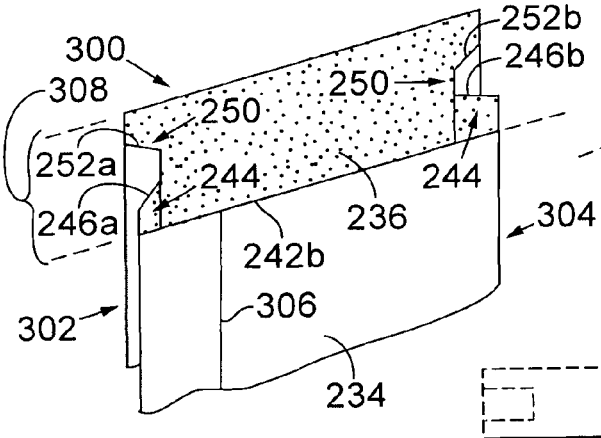
FIG. 19 a perspective view of one open end of an alternative embodiment of a polywoven laminated to paper/poly pinch bottom open mouth bag, fabricated from the blank shown in FIG. 18 and prior to adhesive being applied to the closure section.
Figure 20:
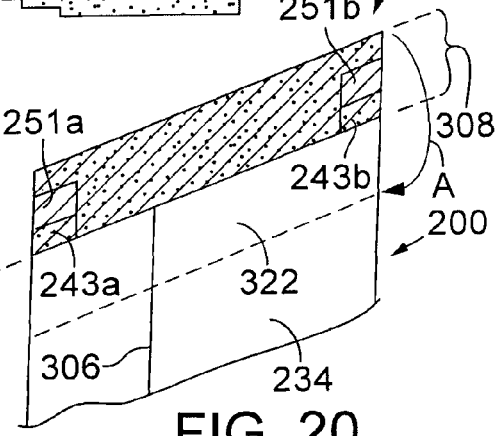
FIG. 20 is a perspective view of the bag end shown in FIG. 19, showing adhesive applied to the closure section.
Figure 21:
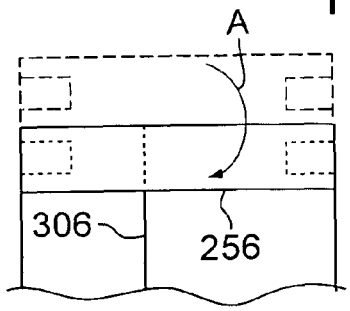
FIG. 21 is a plan view of the bag end shown in FIG. 20, illustrating closure of the end.

Blank 202 is formed into a tube 300 as illustrated in FIGS. 19, 20 and 21. This is done by folding the continuous sheet of blanks described above at gusset fold lines 220, 222 and 224 to form a gusset 302 on one lateral edge of the blank, and folding the blank at gusset fold lines 226, 228 and 230 to define an identical gusset 304 at the opposite lateral edge of the blank. The actual tube 200 having open opposite ends is formed by folding the blank inwardly at gusset fold lines 220 and 230 so that the lateral edge 212 overlaps lateral edge 214. Because there is a strip of the woven fabric layer 204 defined between edges 214 and 216, when the tube 300 is thus formed, there is a facing strip of woven material running in the bag axis direction along the entire length of the now-formed tube. Moreover, there is a slight overlap of the plastic layer 206 that overlaps the edge 214 of on outer layer 210 along the entire length of the bag. The overlapping edges are adhered to one another in an appropriate manner, for example with glue, sonic welding, and/or with heat sealing to define a seam 306 that runs along the length of the bag in the bag axis direction.

When the blank is formed into a tube 300 edges 242*a* and 242*b* align, and the steps 244, 250 and 254 are exposed. At this point the formed tube 300 is laid flat and adhesive is applied to desired exposed portions of the bag at each end to facilitate closing of the ends. With reference to FIG. 20, when the tube is in this position a closure section 308 is defined as that portion of the tube extending beyond the aligned edges 242*a* and 242*b*. Closure section 308 includes the exposed portions of the gussets that define steps 244 and 250, and the exposed portion of rear panel 236 that extends beyond the steps 250. The exposed portions of the gussets are identified in FIG. 20 as tabs 243*a* and 243*b*, and tabs 251*a* and 251*b*.

An adhesive 312 (shown in diagonal solid lines in FIG. 20) such as hot melt adhesive that will not be tacky when dry, yet is able to be adhered later, is applied to the entire exposed surfaces of closure section 308, including tabs 243*a*, 243*b*, 251*a* and 251*b*. The glue is allowed to dry. Glue is likewise applied to the corresponding closure section at the opposite end of tube 300.

The manufactured end 320 of bag 200 is then closed by folding the closure section 308 over the tube 300 in the direction of arrow A in FIGS. 20 and 21 at the aligned edges 242*a* and 242*b*. As this is done, the exposed portions of the closure section, which as noted are coated with hot melt adhesive, cover and come into contact with a section 322 of front panel 234. The thus folded-over closure section is pressed under heat against the facing portions of bag 200 and the surfaces are held together until they are joined firmly. There are no holes or other openings through which contaminants may reach the interior of the bag.

The opposite end, which will is the consumer end (not shown in the drawings), is not closed by the manufacturer, but is instead closed by the consumer after the bag is filled by the customer. The consumer end is closed in an identical manner to manufactured end 320.

As noted above, a bag 200 may be manufactured with flat sides rather than with the gussets shown in FIGS. 18 through 21. Although not illustrated in the drawings, it will be appreciated that a bag having flat, non-gusseted sides will is made from a blank having only one stepped portion that extends completely across the front panel.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. A bulk material bag comprising:

a polywoven bag body having an open end, said bag body having a longitudinal bag axis and the open end having an end edge transverse to the bag axis, said bag body including opposed lateral side edges defining a bag front panel and a bag rear panel;

a tape extending transverse to the bag axis and adhered to the bag rear panel so that a portion of the tape extends beyond the end edge to define an exposed portion of said tape, wherein adhesive is applied to said exposed portion, and wherein the bag front panel is slit at each lateral side edge to define a flap and the flap is folded over and adhered to the front panel.

2. The bulk material bag according to claim 1 wherein the tape extends beyond both lateral side edges.

3. The bulk material bag according to claim 1 wherein the flap includes an exposed portion extending across the bag front panel and adhesive is applied to the exposed portion.

4. The bulk material bag according to claim 3 wherein the open end is closed by folding the exposed portion of the tape over the bag front panel so that the exposed portion of the tape is adhered to the exposed portion of the flap.

5. The bulk material bag according to claim 4 wherein the tape is paper.

6. The bulk material bag according to claim 4 wherein the lateral side edges are gusseted.

* * * * *